US011408695B2

(12) United States Patent
Nelson et al.

(10) Patent No.: US 11,408,695 B2
(45) Date of Patent: Aug. 9, 2022

(54) PISTOL SLIDE WITH SEPARABLE BREECH BLOCK

(71) Applicant: NELSON PRECISION MANUFACTURING, LLC, Tucson, AZ (US)

(72) Inventors: Jeremy Michael Nelson, Tucson, AZ (US); Jeffrey Robert Nelson, Tucson, AZ (US)

(73) Assignee: Nelson Precision Manufacturing, LLC, Tucson, AZ (US)

( * ) Notice: Subject to any disclaimer, the term of this patent is extended or adjusted under 35 U.S.C. 154(b) by 0 days.

(21) Appl. No.: 17/146,873

(22) Filed: Jan. 12, 2021

(65) Prior Publication Data

US 2022/0221237 A1 Jul. 14, 2022

(51) Int. Cl.
*F41A 3/66* (2006.01)
*F41C 3/00* (2006.01)

(52) U.S. Cl.
CPC . *F41A 3/66* (2013.01); *F41C 3/00* (2013.01)

(58) Field of Classification Search
CPC ..... F41A 3/66; F41A 5/05; F41A 5/04; F41C 3/00
See application file for complete search history.

(56) References Cited

U.S. PATENT DOCUMENTS 3,724,326 A * 4/1973 Day ..... F41A 21/10 89/196
5,734,120 A * 3/1998 Besselink ..... F41A 3/14 89/163
2002/0116857 A1* 8/2002 Wonisch ..... F41A 3/64 42/75.02

* cited by examiner

*Primary Examiner* — J. Woodrow Eldred
(74) *Attorney, Agent, or Firm* — Quarles & Brady, LLP

(57) ABSTRACT

A pistol slide with a separable breech block includes a slide and a breech block. The breech block is configured to be secured within the slide such that one face of the breech block forms a breech face within the slide. The breech block and the slide may be made of materials with different density to reduce the weight of the pistol slide while ensuring mechanical compatibility of the pistol slide with various pistol bodies.

16 Claims, 10 Drawing Sheets

PISTOL SLIDE WITH SEPARABLE BREECH BLOCK

TECHNICAL FIELD

This application relates to firearms, and more particularly, to pistol slide mechanisms.

BACKGROUND

Most modern semi-automatic pistols are composed of two major parts: a stationary "frame" or "lower" (i.e., a "lower receiver"), and a moveable upper portion (the "slide"). The slide typically houses the barrel of the pistol and defines a breech block including a breech face. The breech face carries an ammunition cartridge, and the primer of the cartridge is arranged in proximity to the breech face when the pistol is in battery. The breech face, or structures proximate to the breech face, engage with structures on the barrel, typically through a rotating and camming action, when the firearm is in battery and ready to fire. As used herein, "in battery" refers to the slide being locked to a barrel firing chamber located in one end of the barrel, such that an ammunition cartridge is located in the firing chamber and the pistol is ready to fire. The slide also defines structures for housing the firing pin, ejector, extractor, guide rod, and recoil spring. The breech block, typically, is provided as an integral structure to the slide, and provides the breech face having an aperture for a firing pin, as well as the extractor and in certain cases, an ejector. As the slide translates with respect to the frame, as in during firing, the case for a spent cartridge is extracted and ejected, a new round is stripped off of an ammunition magazine located in the frame. The new cartridge is then lodged against the slide breech face and is translated into the barrel firing chamber. The breach face is locked against the barrel, by one or more engagement surfaces, to form, with the barrel firing chamber, a complete firing chamber. An exemplary pistol that functions according to this general design is described in U.S. Pat. No. 4,825,744, entitled Automatic Pistol, issued to Gaston Glock, which is incorporated herein by reference in its entirety.

The slide, when locked to the barrel to form a firing chamber, must safely contain the explosive forces caused by ignition of the cartridge during firing, until such time as the pistol mechanism unlocks the slide breech face from the barrel for extraction and ejection of the spent case. Additionally, the slide must be sufficiently strong to resist cracking or other mechanical failures as it translates, back and forth on the frame, during the firing process. Additionally, the slide mass and the force of the recoil spring must be balanced with the explosive force of the cartridge to ensure that the slide moves the correct distance, at the correct speed, while carrying the correct momentum, during recoil, so that the spent case is successfully extracted and ejected, and a new cartridge is loaded into battery for firing. Specifically, for a striker fired gun such as is described above, during the recoil stroke, the slide must carry sufficient momentum to extract the spent case from the chamber, push the case against an ejector located in the slide, thereby ejecting a round, cock the firing control group (i.e., the trigger), and compress the striker (i.e, the firing pin) spring. It must perform these functions while compressing the recoil spring, then it must have sufficient return momentum to strip the next round off the magazine and place it in battery. This requires that the slide have a mass when a fairly narrow range so that it can perform these functions while overcoming the force of the recoil spring in a reliable and consistent manner.

Because the frame is not subjected to the same mechanical forces as the slide, the modern trend in semiautomatic pistols is to construct the frame out of lightweight polymer materials. Polymers are advantageous because they do not rust, and their use reduces the cost and overall weight of the firearm. These same advantages have prompted manufacturers to attempt to use polymer materials, and other lightweight materials such as aluminum, for slide components. Using lightweight materials in the slide has been attempted, in particular, for rim fire pistols (e.g., pistols chambered in 0.22LR), because these cartridges are less powerful than conventional centerfire cartridges. However, even for rim fire pistols, these attempts to use polymers or lightweight materials like aluminum for pistol slides have been problematic. Reports abound of plastic slides cracking during use, and all-aluminum slides may lack the mass required to reliably cycle the pistol during firing.

SUMMARY

Embodiments of the present invention include a pistol slide made of a first section having a lower density than steel or other conventional slide materials. The first section does not include an integral breech block. Embodiments of the invention include a separable breech block fabricated from a material having a higher density than the first material. In one embodiment, the first slide section is fabricated from aluminum and the breech block is fabricated from steel. In alternative embodiments, the first slide section is fabricated from polymer material and the breech block is fabricated from steel. Other material combinations are possible. The breech block is configured to be secured within the slide such that the first slide section and the breech block, together, have sufficient strength to contain and direct the energy released during firing. Additionally, the breech block material, and its size, may be chosen such that the breech block and slide, together, have sufficient mass to ensure reliable cycling of the firearm.

Aspects of the invention have certain advantages. For example, by providing a separable breech block component, the breech may be replaced in the event that it becomes worn or damaged. Additionally, the use of steel as a breach block material enables construction of a durable breech block that can better withstand the mechanical shock of firing and cycling. Thus, a steel breech block may be combined with an aluminum or polymer slide to achieve a weight savings over unibody slides (e.g., unibody steel slides) while still being sufficiently durable. Additionally, the breech block material may be selected to increase the overall mass of the slide, such that in combination with lighter or less dense slide materials, the overall mass of the slide is maintained at a level enabling the impulse delivered by the slide to reliably cycle the gun. For example, in certain embodiments, the separable breech block is steel, while the slide is polymer or aluminum. In other embodiments, the separable breech block is tungsten, while the slide is polymer. Any combination of breech block and slide materials is possible and within the scope of the invention.

In certain embodiments, a kit is provided having a variety of breech blocks made of materials with different densities, so that a user may select a breech block of an appropriate weight. For example, the user may be provided with three breech blocks, one of aluminum, one of steel, and one of tungsten. The availability of different breech blocks of different weights allows the user to select a breech block to obtain a desired overall slide weight when used with a slide of a particular material. This arrangement enables the user to fine tune the overall mass of the slide, to optimize the performance of the gun when used with various types of ammunition, recoil spring weights, and accessories such as suppressors, all of which impact the cycling dynamics of the gun.

The use of a separable breech block confers additional advantages. As one example, the separable breech block disclosed herein may be easily removed for repair or replacement. As a further example, the slide and separable breech block arrangements herein may have better tolerance for different coefficients of thermal expansion of the breech block and the slide when compared to other slide assemblies that incorporate two or more materials.

Additionally, the separable breach block according to certain inventive embodiments may be coated with a different coating than the material of the slide. For example, the breach block may be coated or treated to produce a nickel-boron coating, to increase its lubricity and to ease cleaning. Alternatively, the breech block may be powder coated or anodized different colors, to contrast with the color of the slide, for aesthetic purposes.

Additionally, the use of a separable breech block made of a hard, high strength, material such as steel, provides a secure mounting platform for auxiliary optics such as reflex sights (commonly referred to as "red dot" sights). In conventional pistols, an upper or dorsal surface of the slide is tapped for receipt of fasteners (e.g., screws), which are used to secure a reflex sight. When the slide is steel, this is typically not a problem, however, threads in polymer or aluminum can be easily stripped. Conventionally, this is addressed with steel threaded sleeves or inserts, however, this introduces an additional slide manufacturing step. Additionally, inserts can back out or can be installed at off normal angles, thereby resulting in the optic being misaligned. Certain embodiments of the invention overcome these disadvantages by providing a separable breech block with posts that extend upwardwardly through apertures located in the slide. The posts define threaded, cylindrical sleeves that receive fasteners (e.g., screws) that may be used to secure an auxiliary optical sight to the top of the slide. This arrangement may also serve to secure the breech block into the slide. This arrangement has the further advantage of mounting an auxiliary optic such that it is referenced directly to the breech block, which sits along the bore axis of the gun, thus providing a highly accurate method for initial alignment of the optic.

Additional advantageous embodiments include a replaceable breech face post or stub, which is separably securable to the breech block. This embodiment allows easy replacement of a breech face should it become worn or damaged. The arrangement also enables the use of different materials for the breech face post, as compared to both the breech block and the slide, which may further allow for fine turning of the overall mass of the gun. Additionally, the breech block itself may include a separably securable weight, i.e., by defining a chamber that receives a weight of, for example, tungsten, to further allow the user to fine tune the overall mass of the slide. Multiple weights of different weight may be provided to assist in this fine tuning process.

The foregoing and other advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims and herein for interpreting the scope of the invention.

BRIEF DESCRIPTION OF THE DRAWINGS

The accompanying drawings, which are incorporated in and form a part of this specification, illustrate embodiments of the invention and, together with the description, serve to explain the principles of embodiments of the invention.

DETAILED DESCRIPTION

Figure 1:
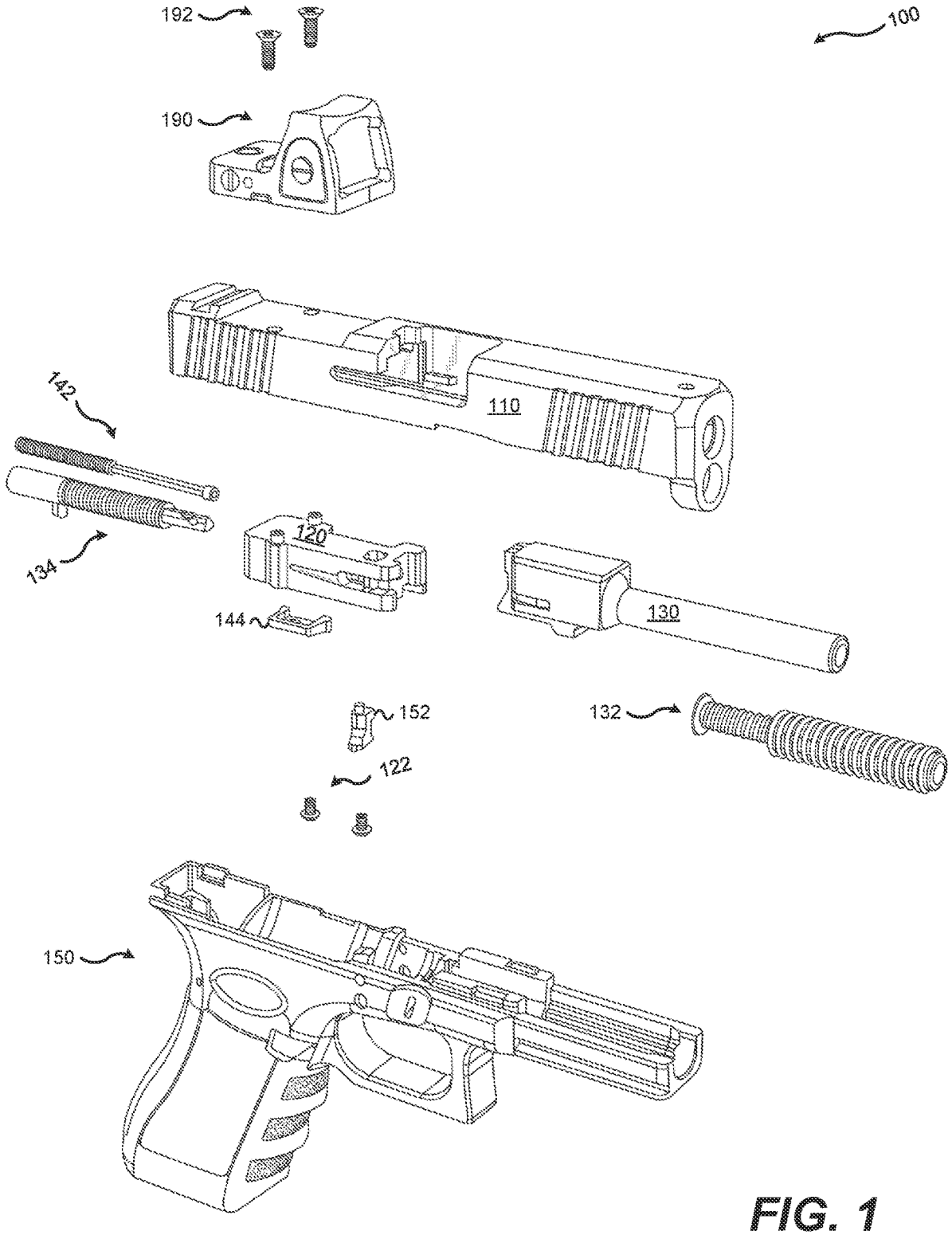
FIG. 1 is an exploded perspective view of an example pistol having a slide with a separable breech block according to embodiments herein.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein.

As used herein, unless otherwise specified or limited, "at least one of A, B, and C," and similar other phrases, are meant to indicate A, or B, or C, or any combination of A, B, and/or C. As such, this phrase, and similar other phrases can include single or multiple instances of A, B, and/or C, and, in the case that any of A, B, and/or C indicates a category of elements, single or multiple instances of any of the elements of the categories A, B, and/or C.

Also, it is to be understood that the phraseology and terminology used herein is for the purpose of description and should not be regarded as limiting. The use of "including,"

"comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Unless explicitly species otherwise, terms indicating orientation such as "top," "bottom," "upper," "lower," "left," "right," and so on are used with reference to orientations of the drawings as an aid to understanding and not to indicate any required orientation.

Disclosed herein is a pistol slide assembly. In an embodiment the slide assembly includes a slide and a breech block. The slide is formed from a first material that has a first density and the breech block is formed from at least a second material that has a second density. The breech block is enclosed by the slide and removable from the slide. The breech block has a breech face configured to form a pistol breech surface. The pistol breech surface has a firing aperture configured to allow a firing pin to pass through the firing aperture.

In certain embodiments the slide has a top surface, front and rear faces, and first and second ends. The front and rear faces are coupled, respectively, to the top surface at the first and second ends of the slide, and the first and second sides are coupled to the top surface and the front and rear faces. The top surface, the front and rear faces, and the first and second sides are jointly dimensioned to define a recess beneath the top surface and surrounded by the top surface and the first and second sides. The top surface includes a breech opening disposed between the front face and the rear face corresponding to a pistol breech. The recess is dimensioned to receive the breech block within a breech region of the slide disposed between the breech opening and the rear face of the slide.

In some such embodiments the breech region of the slide includes one or more inwardly projecting protrusions arranged on the first or second sides. In these embodiments, the breech block is dimensioned to have, on a side surface of the breech block, one or more indentations that are complementary to the one or more protrusions of the breech region of the slide such that, when the breech block is disposed within the breech region, the one or more indentations surround and contact the one or more protrusions such that breech block is prevented from moving along at least two axes within the slide.

In some such embodiments, the breech region of the slide includes one or more indentations in a side of the slide. In these embodiments, the breech block is dimensioned to have, on a side surface of the breech block, one or more protrusions that are complementary to the one or more indentations of the breech region of the slide such that, when the breech block is disposed within the breech region, the one or more indentations surround and contact the one or more protrusions and the breech block is prevented from moving along at least two axes within the slide.

In some such embodiments, the breech block has one or more anchoring points configured to allow the breech block to be fastened within the breech region of the slide. In some embodiments, the top surface of the slide in the breech region has one or more openings and the breech block includes one or more threaded posts dimensioned and arranged to pass through the one or more openings in the top surface of the slide. In these embodiments, the top surface of the slide and the breech block are jointly configured and dimensioned to allow the breech block to be at least partially fastened to the slide with a threaded fastener dimensioned and configured to pass through the openings in the top surface and couple to threads of the threaded posts.

In some embodiments, the one or more threaded posts of the breech block are dimensioned such that, when the breech block is secured within the recess, the threaded posts do not extend above the top surface of the slide.

In some embodiments, the top surface of the slide is dimensioned with a recessed region that includes the openings in the top surface, the recessed region configured to receive an accessory device configured to be secured to the threaded posts.

In certain embodiments, the front face and the rear face of the slide are disposed opposite each other along a longitudinal axis of the slide, the front face configured to form at least part of a pistol muzzle. In some such embodiments, the assembly also includes a firing pin channel disposed within the recess of the slide between the rear face of the slide and dimensioned to allow passage of a firing pin through the channel to the firing aperture. In these embodiments, the breech block includes a second firing pin channel and, when the breech block is disposed within the recess of the slide within the breech region, the second firing pin channel allows passage of the firing pin from the first firing pin channel to the firing aperture via the second firing pin channel.

In certain embodiments, the breech block includes a first portion formed from the second material and a stub configured to be fastenable to the first portion of the breech block. In these embodiments, when the stub is fastened to the first portion of the breech block, a front surface of the stub forms the breech surface of the breech block. In some of these embodiments, the stub is formed from a third material with a third density.

Referring now to the figures, and in particular to FIG. 1, an example pistol 100 is shown in an exploded view. The pistol 100 has a slide 110 configured to house a breech block 120, a barrel 130, a recoil spring 132 arranged around a guide rod, a firing pin assembly 134, and an extractor depressor assembly 142. The slide is also configured to be slideably attached to a frame or lower 150 through interface between undercuts on slide 110 and frame rails on the frame. The pistol 100 also includes an extractor 144, which is configured to move within (i.e., rotate within) the breech block 120 during operation of the pistol 100. The slide 110 of pistol 100 is also configured to accept a firing pin safety assembly 152. Also shown is an auxiliary optic 190 which may be mounted to the slide 110 using the screws 192. The screws 192 may also be used, along with the screws 122, to secure the breech block 120 to the slide 110, as described further below.

FIGS. 2A-D show an example slide 210 (e.g., the slide 110) and an example breech block 220 (e.g., the breech block 120) according to some embodiments. The slide 210 has a first end 210*a* configured to house a pistol barrel (not shown), a second end 210*b*, a top surface 215*a*, a first side 215*b*, and a second side 215*c* opposite the first side 215*b* (not visible in FIG. 2A). The slide's top surface 215*a* and the first side 215*b* are opened in a breech region (hereinafter the breech 212) corresponding to the breech of a pistol (e.g., the pistol 100) between the first and second ends 210*a*, 210*b*. In alternative embodiments, slide 210 may define additional cutouts or openings in the sides 215*a-c* for reasons of weight savings or aesthetics. The top surface 215*a* may be provided with a set of openings 211 (represented by two through-holes) and the sides 215*b*,215*c* include notches 218 configured to register the slide 210 to a pistol body (e.g., the body 150 of the pistol 100 of FIG. 1) and limit motion of the slide 210 relative to such a pistol body. Together, the top surface 215*a*, the sides 215*b*, 215*c*, and the ends 210*a*, 210*b* define a recess 217 (beneath the top surface 215*a* (visible in FIG. 2C and FIG. 2D and described further below in connection with those figures).

Figure 5:
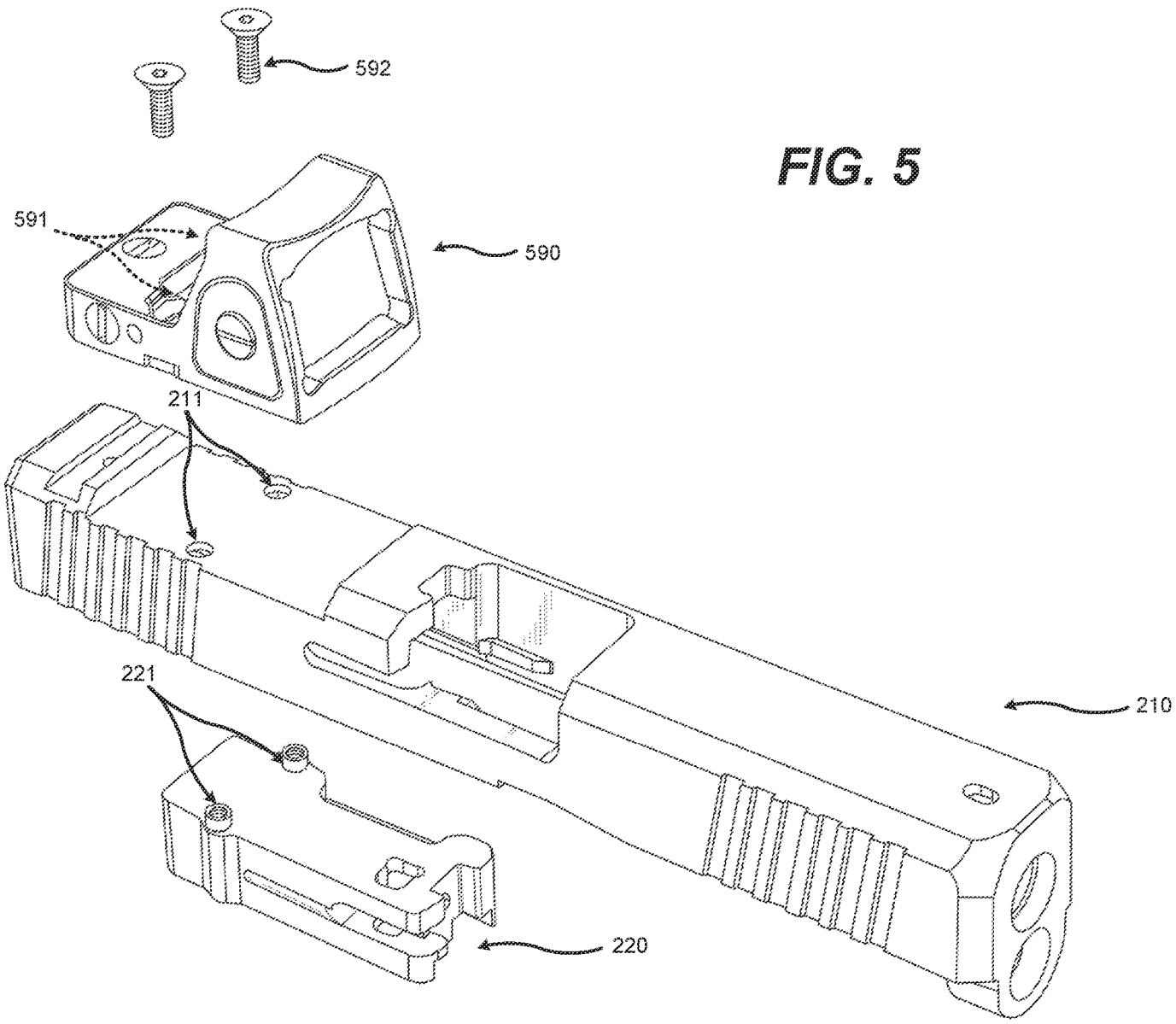
FIG. 5 is an exploded perspective view showing the slide and the breech block of FIG. 1 as well as a plate which may be coupled to the slide for use as a spacer or as a mounting plate.
Figure 6:
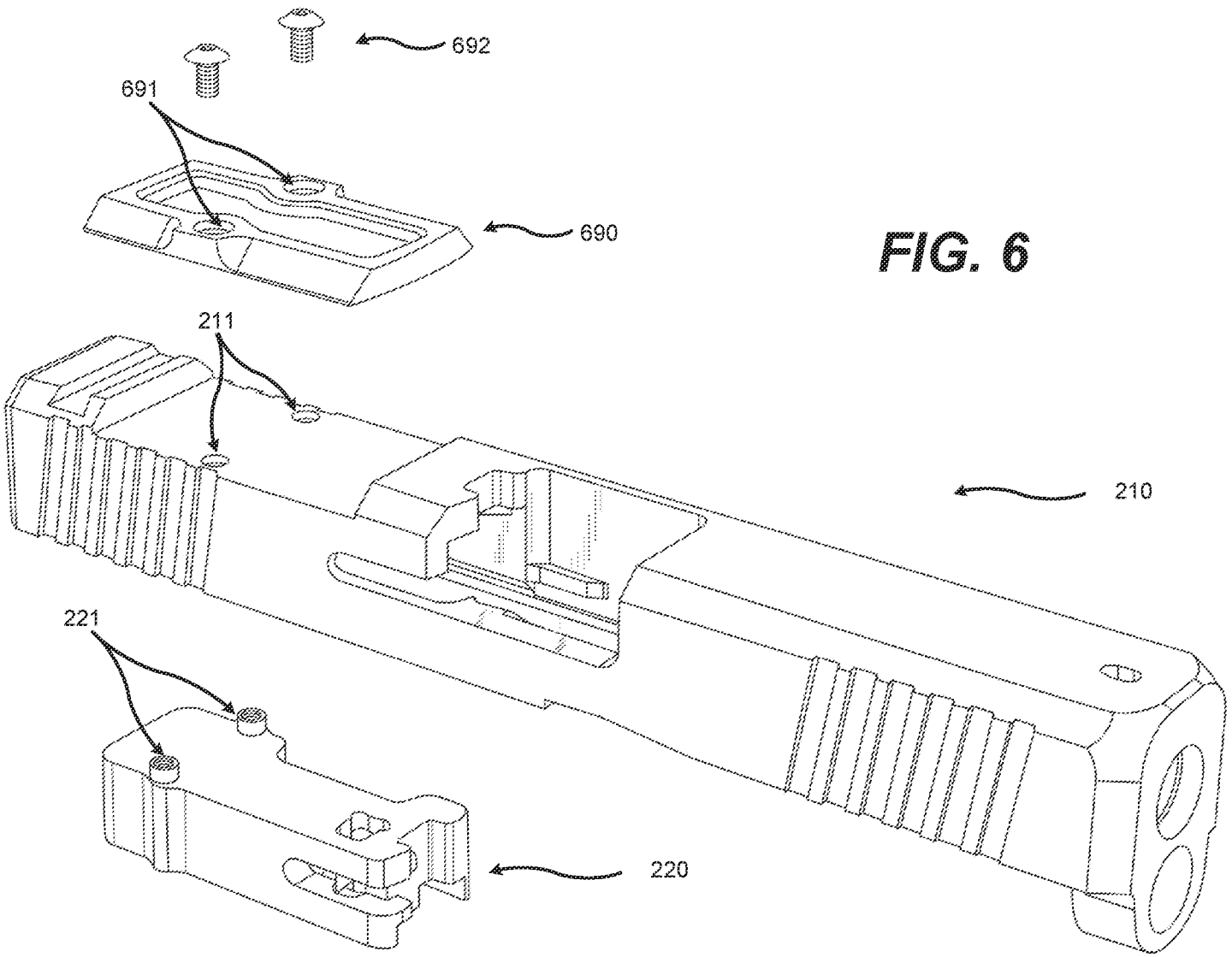
FIG. 6 is an exploded perspective view showing the slide, breech block, and a sighting device shown in FIG. 1 in greater detail.

The breech block 220 has a top surface 220*a*, sides 220*b,c* (the side 220*c* is visible in FIG. 2B), a rear face 220*e* (visible in FIG. 3E and FIG. 4) and a breech face 222. The breech face 222 is configured to form the breech face of a pistol (e.g., the pistol 100) when secured within the slide 210. The breech face 222 is further configured to receive the rear of an ammunition cartridge and translate the cartridge forward into a firing chamber defined by the interface of the breech block 220 and the barrel. The breech block 220 is configured to be inserted and secured within the slide 210 at a position between the breech 212 and the second end 210*b*. In certain embodiments, breech block 220 is secured into slide 210 with one or more fasteners (e.g., 122), which fasten the breech block to the slide along the side of the breech block centerline. In certain optional embodiments, when the breech block 220 is positioned within the slide (described further below in connection with FIGS. 2C-2D), threaded posts 221 pass through the through-holes 211 in the slide 210, but do not extend beyond the top surface 215*a*. Threaded fasteners may be inserted into the threaded posts 221 through the openings 211 in the top surface. In some embodiments, as illustrated by FIG. 5, the openings 211 and the threaded posts 221 may be dimensioned to pass through a mounting plate or other spacer. In some embodiments, as illustrated by FIG. 6, the openings 211 and the threaded posts 221 may be dimensioned to pass through an auxiliary optic or other attachment.

Figure 2A:
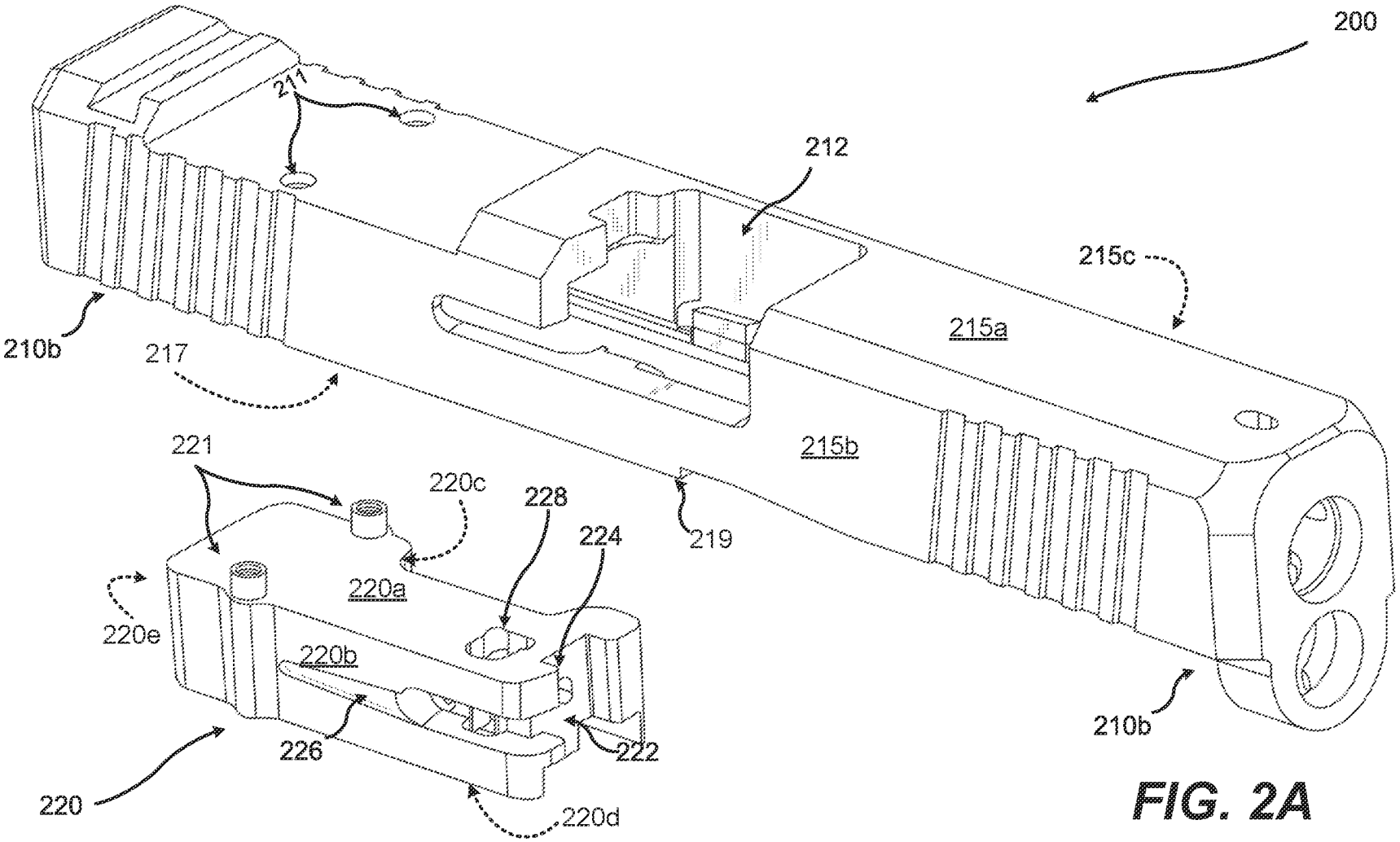
FIG. 2A is a right perspective view of the slide and the breech block shown in FIG. 1.

The breech block 220 may be dimensioned to interface with various components of a firearm such as the pistol 100 of FIG. 1. As shown in FIG. 2A, the breech block 220 has an firing pin aperture 225 within the breech face 222 dimensioned to allow a firing pin (e.g., the tip of the firing pin assembly 134 of FIG. 1) to pass through in order to impact the primer in an ammunition cartridge. The breech block 220 may also include a channel such as the extractor channel 226 shown that is dimensioned to allow passage of an extractor plunger (e.g., the extractor plunger 142 of FIG. 1) through the breech block 220. Breech block 220 is also configured to accept an extractor (e.g., the extractor assembly 144 of FIG. 1, or the extractor assembly 344 of FIG. 3) in the vicinity of the breech face. The breech block 220 may also be dimensioned to allow a firing pin safety assembly (e.g., the firing pin assembly 152 of FIG. 1, or the firing pin assembly 352 of FIG. 3) to pass into a the breech block 220, via the safety channel 227 shown in FIG. 2A, to prevent a firing pin (e.g., the firing pin assembly 134 of FIG. 1) from striking an ammunition round loaded in the breech 212.

Figure 2B:
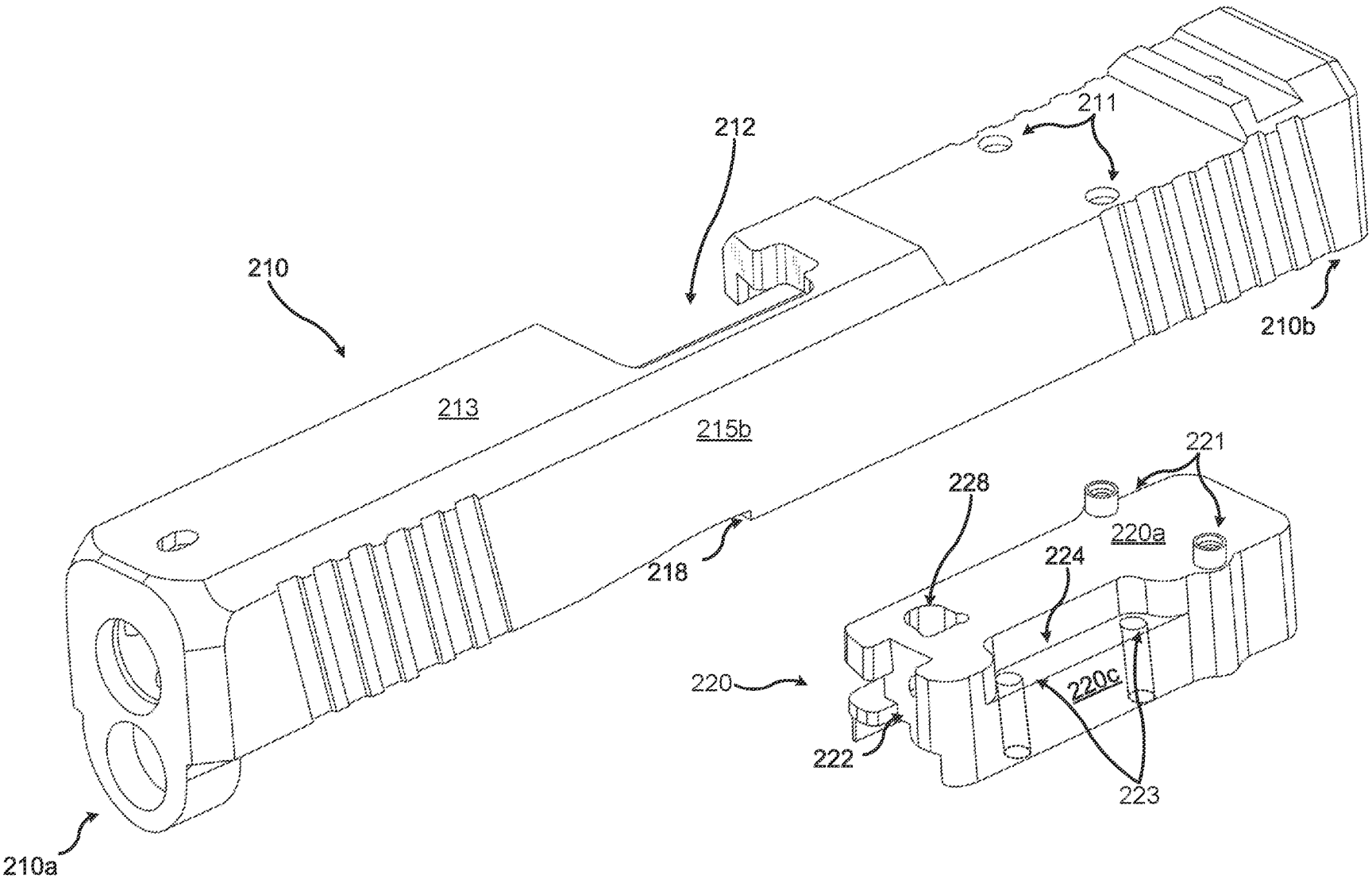
FIG. 2B is a left perspective view of the slide and the breech block shown in FIG. 1.

FIG. 2B is an additional perspective view of the slide 210 and the breech block 220, rotated to show the second side 215*c* of the slide 210 and the side 220*c* of the breech block 220. As shown in FIG. 2B, the breech block 220 may be provided with channels, such as the channels 223 shown, that are dimensioned to allow passage of pins or threaded fasteners (e.g., screws) through the breech block 220, as will be described further in connection with FIGS. 2C and 2D. As shown, the channels 223 reside within a shelf 224 of the breech block 220 which is dimensioned to mate with a corresponding protrusion 214 of the slide 210 as shown in FIGS. 2C and 2D and described further below in connection with those figures.

Figure 2C:
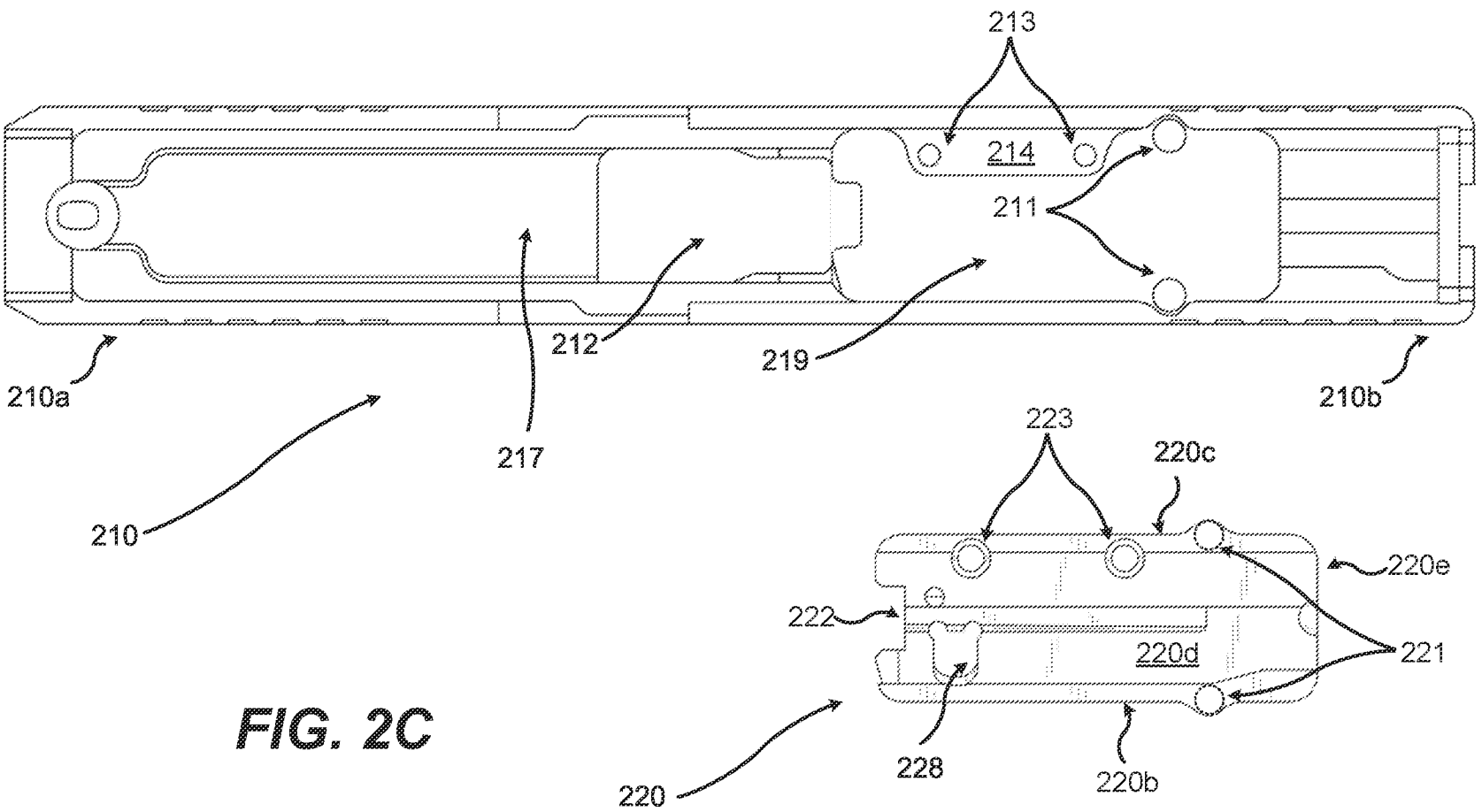
FIG. 2C is a bottom plan view of the slide and the breech block shown in FIG. 1.

FIG. 2C is a plan view of the slide 210 and the breech block 220 showing the recess 217 beneath the top surface 215*a* of the slide and the bottom surface 220*d* of the breech block 220. The recess 217 includes a region 219 dimensioned to receive the breech block 220. The openings 211, the channels 213, and the protrusion 214 are all disposed within the region 219. As shown, the contours of the sides 220*b*, 220*c*, and 220*e* of the breech block 220, as well as the breech face 222 are dimensioned to correspond to (and rest within) contours of the recess 217 within the region 219. The channels 223, together with the shelf 224, are dimensioned, together with the shape of the sides 220*b*, 220*c* such that the breech block 220 may be positioned correctly within the recess 217 to align with other components (e.g., the firing pin assembly 134, the extractor plunger assembly 142, extractor 144, barrel 130, firing pin safety assembly 152, et. al. of the pistol 100 of FIG. 1) and secured to the slide 210 using fasteners that may include screws, as a nonlimiting example.

Figure 2D:
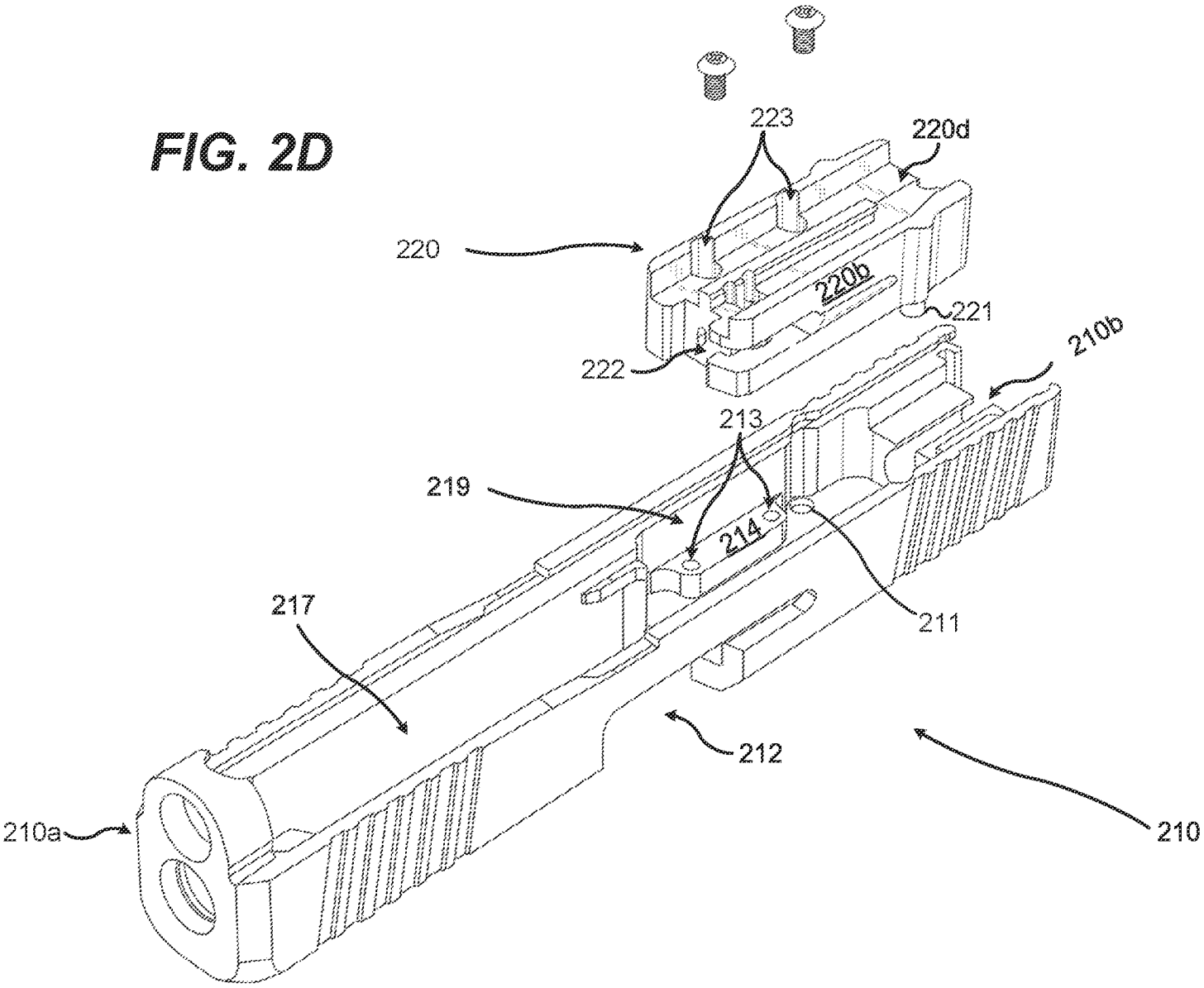
FIG. 2D is a bottom perspective view of the slide and the breech block shown in FIG. 1.

FIG. 2D is an upward facing perspective view of the slide 210 and the breech block 220, as shown in the plan view of FIG. 2C. A channel dimensioned to accommodate a firing pin assembly (e.g., the firing pin assembly 134 of FIG. 1 is shown within the recess 217 near the region 219 at the end 210*b* of slide 210. When the breech block 220 is fully inserted into the recess 217 at the region 219, a firing pin may be passed through the channel at the end 210*b* of the slide 210 and into the breech block 220, as further illustrated in FIG. 3.

Figure 3:
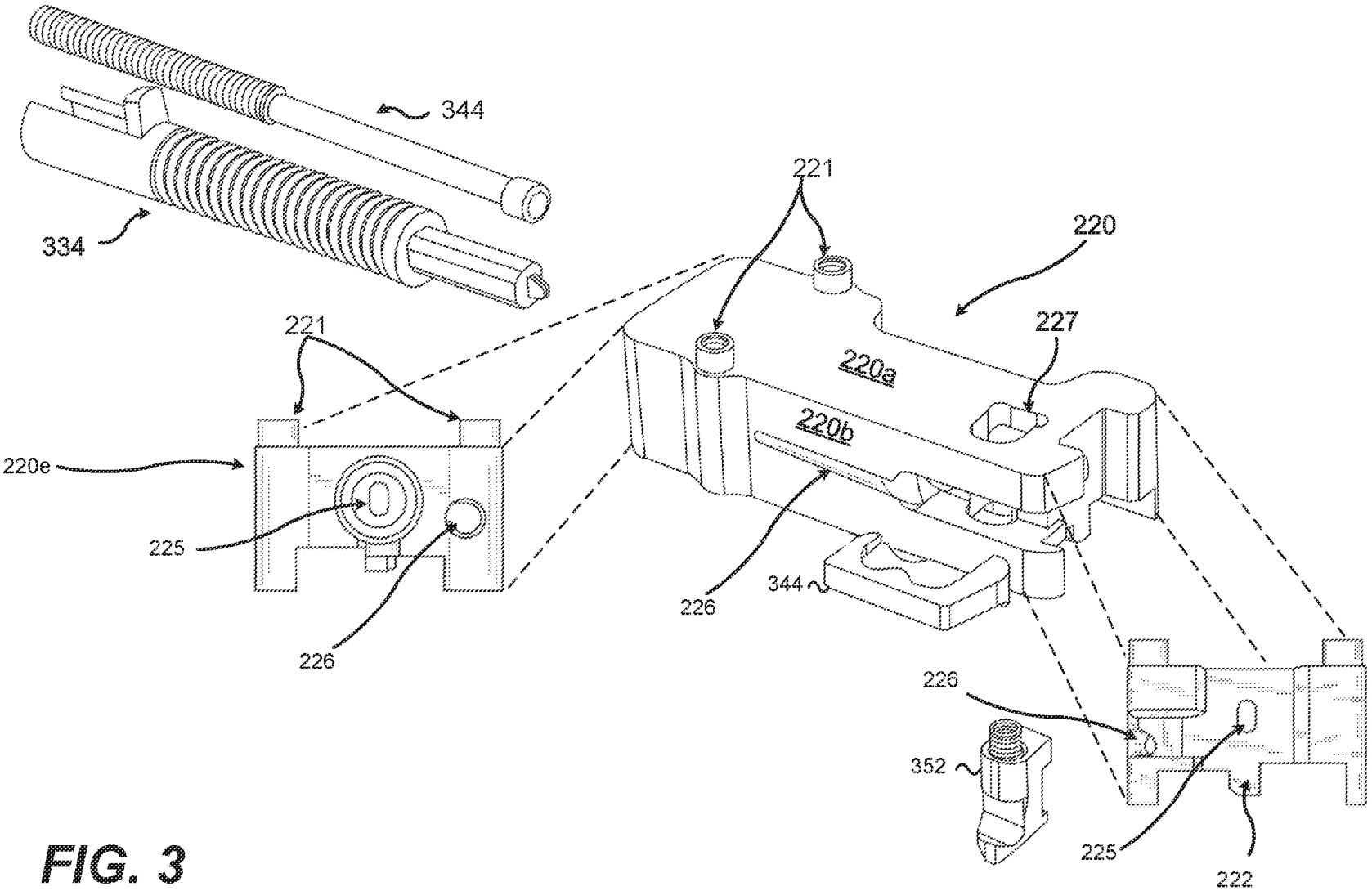
FIG. 3 is a perspective view of the breech block, firing pin, ejector, and extractor of FIG. 1 that incorporates plan views of two sides of the breech block.

FIG. 3 is a side perspective view illustrating functioning of other components firearm components relative to the breech block 220. FIG. 3 also includes elevation views of the rear face 220*e* and the breech face 222 of the breech block 220. As shown, the firing aperture 225 is widest at the rear face 220*e* of the breech block 220 and narrows along its length in order to accommodate a firing pin assembly 334 (e.g., the firing pin assembly 134 of FIG. 1). At the other end (i.e., at the breech face 222), the firing aperture 225 is narrowed such that only the firing pin itself may pass through (i.e., the narrow tip of the firing pin assembly 334). Also visible in FIG. 3 is the extractor channel 226 dimensioned to allow passage of the extractor plunger assembly 342 (e.g., the extractor plunger assembly 142 of FIG. 1) which begins at the rear face 220*e* and continues toward the breech face 222 until it reaches the open portion of the side 220*b* of the breech face 222. This open portion is dimensioned to accept an extractor assembly 344 (e.g., the ejector assembly 144 of FIG. 1). The channels arranged in the breech block 220 for the extractor plunger assembly 342 and the firing pin assembly 334 are co-aligned with respective channels in the slide itself. In other words, extractor plunger assembly 342 and the firing pin assembly 334 pass through both a rear portion of the slide (210*b*) and the breech block 220.

Figure 4A:
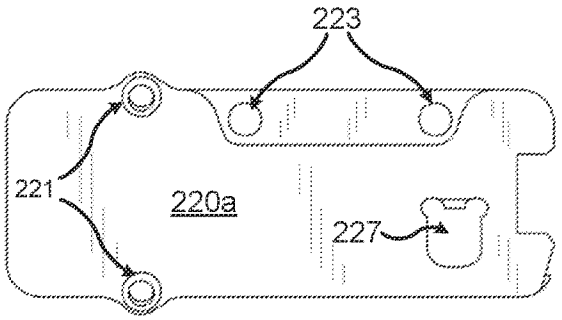
FIGS. 4A-B are top and bottom plan views of the breech block of FIG. 1 and FIGS. 2A-D.
Figure 4B:
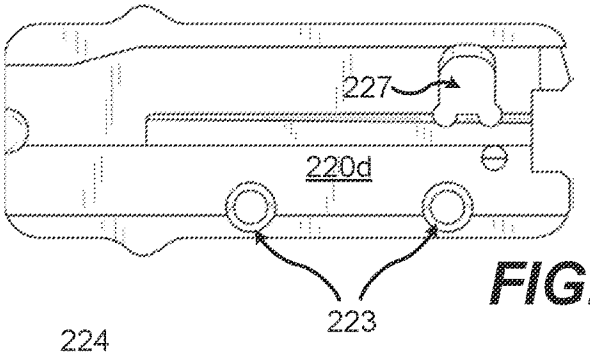
Figure 4C:
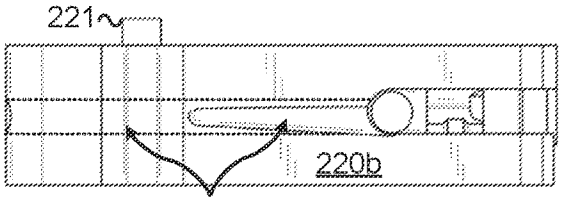
FIGS. 4C-4F are side elevation views of the breech block of FIG. 1 and FIGS. 2A-D.
Figure 4D:
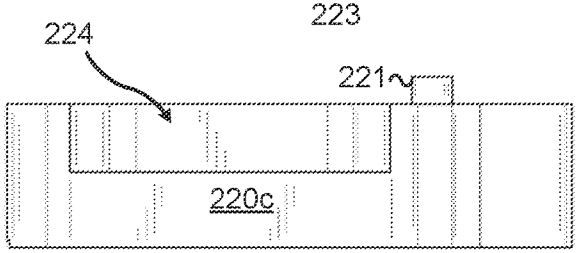
Figure 4E:
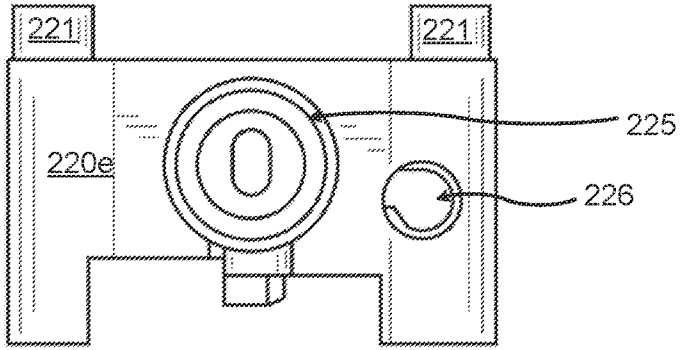
Figure 4F:
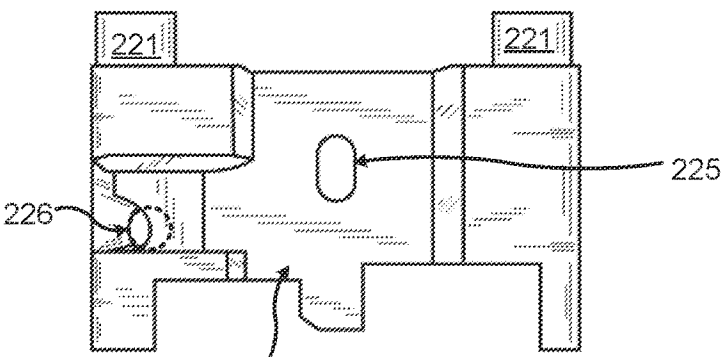

FIGS. 4A and 4B are plan views of the top surface 220*a* and bottom surface 220*d* of the breech block 220, showing features described above. FIG. 4C shows the exposed portion of the extractor channel 226 and indicates the portion of the extractor channel 226 that passes through the breech block 220 with dashed lines. FIGS. 4C and 4D are elevation views of the sides 220*b*, 220*c* of the breech block 220 showing features described above. FIGS. 4E and 4F are elevation views of the rear face 220*e* and the breech face 222 of the breech block 220. FIG. 4F shows a portion of the extractor channel 226 visible when viewing the breech face 222 end-on and indicates a portion of the extractor channel 226 that is occluded in the this view by dashed lines.

FIGS. 5 and 6 show exploded views of the slide assembly 200 with additional accessory parts. For example, the slide assembly 200 may be configured to receive an auxiliary optic 590 (e.g. a "red dot" optic or reflex sight, also pictured in FIG. 1). The threaded posts 221 of the breech block 220 may be configured to protrude above the top surface 215*a* of the slide 210 and into openings 591 (not visible) in the laser sighting device 590. Screws 592 may be used to simultaneously secure the laser sighting device 590 to the slide assembly 200 and (at least partially) secure the breech block 220 within the slide 210. In such embodiments, removal of the laser sighting device 590 may will result in the threaded posts 221 left protruding above the top surface 215*a* of the slide 210, making it impractical to secure the breech block 220 using conventional screws. This may be addressed by the use of a delete plate as shown in FIG. 6. The delete plate 690 is dimension such that the threaded posts 221 rest within the recesses 691 of the delete plate 690. The recesses 691 provide a surface against which screw heads may press when tightened into the threaded posts 221. Thus, the screws 692 may be used to secure the delete plate 690 to the slide assembly 200 and to (at least partially) secure the breech block 220 within the slide 210 when the auxiliary optic 590 (or any other similar accessory) is not installed.

Figure 7A:
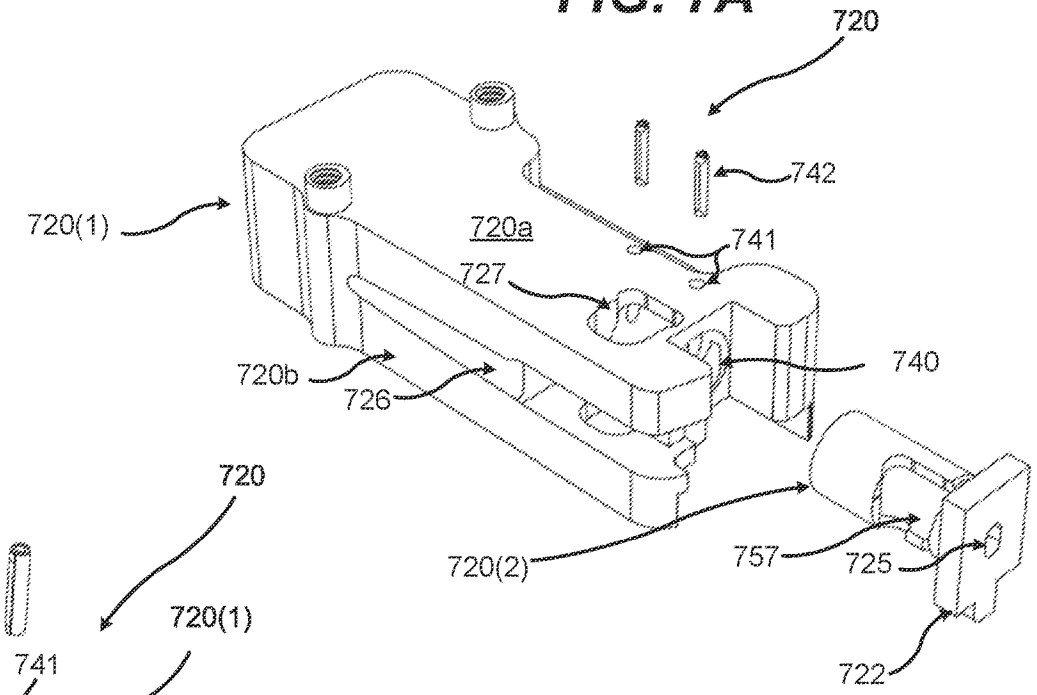
FIGS. 7A-7B are top and bottom perspectives views of a breech block according to certain embodiments.
Figure 7B:
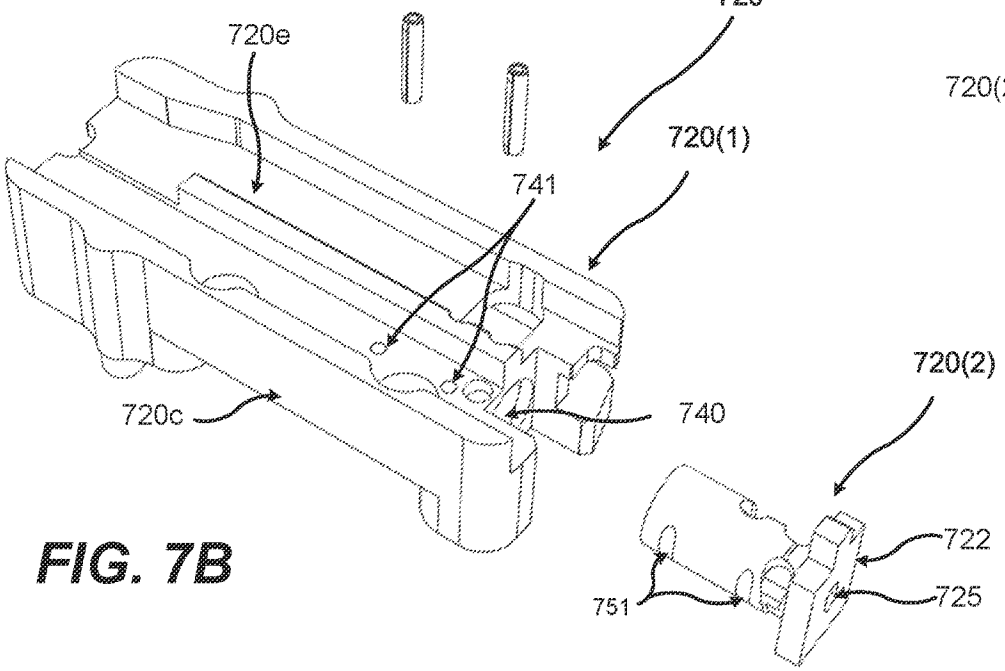

In some embodiments, a breech block may comprise two or more pieces. A breech block 720 is shown in FIGS. 7A and 7B as a nonlimiting example of such a breech block. FIG. 7A is an exploded top perspective view of the breech block 720 and FIG. 7B is an exploded bottom perspective view. The top surface 720*a* and side surface 720*b* of the breech block 720 are visible in FIG. 7A. The bottom surface 720*e* and side surface 720*c* of the breech block 720 are visible in in FIG. 7B.

The breech block 720 is formed from two pieces: the first portion 720(2) and a second portion, the stub 720(2). The stub 720(2) includes a front surface 722 and is configured to be inserted and fastened into the chamber 740 in the first portion 720(1). When the stub 720(2) is fastened into the chamber 740, the top surface 722 of the stub 720(1) forms a breech face (similar to the breech face 222 of the breech block 220 of FIG. 2) with a firing pin aperture 725 (similar to the firing pin aperture 225 of the breech block 220 of FIG. 2).

The stub 720(1) may be dimensioned to be press-fitted into the chamber 740 and may be further secured using pins such as the pins 742, or using any other suitable method, including screws (not pictured). The first portion 720(1) may be dimensioned with slots 741 and the stub 720(2) may be dimensioned with corresponding slots 751 configured to receive the pins 742. The stub 720(2) may also be dimensioned with a cut-away 757 corresponding to the safety channel 727 in order to allow passage of firing pin safety assembly (e.g., the firing pin assembly 152 of FIG. 1, or the firing pin assembly 352 of FIG. 3) as described in connection with FIGS. 1-3.

Embodiments with multipart breech blocks such as the breech block 720 may have further advantages over embodiments with unibody breech blocks such as the breech block 220. For example, further cost savings, weight savings, and other benefits may be realized by selecting different materials for each component (i.e., the first portion 720(1) and the stub 720(2) of the breech block 720 as well as the slide into which the breech block is inserted). In one example, a slide (e.g., the slide 210) may be formed from aluminum or polymer materials. Meanwhile, a first portion of a multipart breech block may be formed from a denser material such as steel while a stub may be formed from a material that is denser still (or has other favorable properties), such as tungsten. Along these lines, different surface coatings or material treatments may be applied to each component for either functional or aesthetic purposes.

What is claimed is:

1. A pistol slide assembly comprising:

a slide formed from a first material with a first density; and a breech block enclosed by the slide and formed from a second material with a second density, the breech block having a breech face configured to form a pistol breech surface having a firing aperture configured to allow a firing pin to pass through the firing aperture, the breech block being removable from the slide, wherein the slide has a top surface, front and rear faces coupled, respectively, to the top surface at first and second ends of the slide, and first and second sides coupled to the top surface and the front and rear faces;

the top surface, the front and rear faces, and the first and second sides are jointly dimensioned to define a recess beneath the top surface and surrounded by the top surface and the first and second sides;

the recess is dimensioned to receive the breech block within a breech region of the slide disposed between the breech opening and the rear face of the slide, the top surface of the slide in the breech region has one or more openings;

the breech block includes one or more threaded posts dimensioned and arranged to pass through the one or more openings in the top surface of the slide.

2. The slide assembly of claim 1, wherein the breech block has a different color than the slide.

3. The slide assembly of claim 1, wherein the slide is fabricated from aluminum and the breech block is fabricated from steel.

4. The slide assembly of claim 1, wherein the slide is fabricated from polymer and the breech block is fabricated from steel.

5. The slide assembly of claim 1, wherein the breech block is fabricated from one of aluminum, steel and tungsten.

6. The assembly of claim 1, wherein:

the top surface includes a breech opening disposed between the front face and the rear face corresponding to a pistol breech.

7. The assembly of claim 6, wherein:

the breech region of the slide further includes one or more inwardly projecting protrusions arranged on the first or second sides; and the breech block is dimensioned to have, on a side surface of the breech block, one or more indentations that are complementary to the one or more protrusions of the breech region of the slide such that, when the breech block is disposed within the breech region, the one or more indentations surround and contact the one or more protrusions such that breech block is prevented from moving along at least two axes within the slide.

8. The assembly of claim 6, wherein:

the breech region of the slide includes one or more indentations in a side of the slide; and the breech block is dimensioned to have, on a side surface of the breech block, one or more protrusions that are complementary to the one or more indentations of the breech region of the slide such that, when the breech block is disposed within the breech region, the one or more indentations surround and contact the one or more protrusions and the breech block is prevented from moving along at least two axes within the slide.

9. The assembly of claim 6, wherein the breech block further includes one or more anchoring points configured to allow the breech block to be fastened within the breech region of the slide.

10. The assembly of claim 9, wherein:

the top surface of the slide and the breech block are jointly configured and dimensioned to allow the breech block to be at least partially fastened to the slide with a threaded fastener dimensioned and configured to pass through the openings in the top surface and couple to threads of the threaded posts.

11. The assembly of claim 1, wherein the one or more threaded posts of the breech block are dimensioned such that, when the breech block is secured within the recess, the threaded posts do not extend above the top surface of the slide.

12. The assembly of claim 1, wherein the top surface of the slide is dimensioned with a recessed region that includes the openings in the top surface, the recessed region configured to receive an accessory device configured to be secured to the threaded posts.

13. The assembly of claim 6, wherein the front face and the rear face of the slide are disposed opposite each other along a longitudinal axis of the slide, the front face configured to form at least part of a pistol muzzle.

14. The assembly of claim 13, the assembly further comprising:

a firing pin channel disposed within the recess of the slide between the rear face of the slide and dimensioned to allow passage of a firing pin through the channel to the firing aperture;

wherein the breech block includes a second firing pin channel; and wherein, when the breech block is disposed within the recess of the slide within the breech region, the second firing pin channel allows passage of the firing pin from the first firing pin channel to the firing aperture via the second firing pin channel.

15. The assembly of claim 2, wherein the breech block comprises:

a first portion formed from the second material and a stub configured to be fastenable to the first portion of the breech block;

wherein, when the stub is fastened to the first portion of the breech block, a front surface of the stub forms the breech face of the breech block.

16. The assembly of claim 15, wherein the stub is formed from a third material with a third density.

* * * * *